US010067439B2

(12) United States Patent
Imase

(10) Patent No.: US 10,067,439 B2
(45) Date of Patent: Sep. 4, 2018

(54) CHARGING ROLLER, AND METHOD OF PRODUCING THE SAME

(71) Applicant: SUMITOMO RUBBER INDUSTRIES, LTD., Kobe-shi, Hyogo (JP)

(72) Inventor: Yuta Imase, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/855,222

(22) Filed: Dec. 27, 2017

(65) Prior Publication Data

US 2018/0210364 A1 Jul. 26, 2018

(30) Foreign Application Priority Data

Jan. 23, 2017 (JP) ..... 2017-009486
Apr. 7, 2017 (JP) ..... 2017-076825

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
See application file for complete search history.

(56) References Cited

U.S. PATENT DOCUMENTS 9,746,792 B1 * 8/2017 Hayashi ..... G03G 15/0233
9,817,328 B2 * 11/2017 Miura ..... G03G 15/0233

FOREIGN PATENT DOCUMENTS

JP 11-194580 A 7/1999
JP 2006-243374 A 9/2006
JP 2006-243375 A 9/2006
JP 2011-95725 A 5/2011

* cited by examiner

*Primary Examiner* — Sandra Brase
(74) *Attorney, Agent, or Firm* — Birch, Stewart, Kolasch & Birch, LLP

(57) ABSTRACT

A charging roller is provided which has a simple construction without provision of a coating film and yet is capable of uniformly electrically charging the surface of a photoreceptor body and more advantageously suppressing adhesion and accumulation of fine particles. A charging roller production method is also provided. The charging roller (1) includes a roller body (2) having an outer peripheral surface (5) which includes a surface roughness component including a multiplicity of asperities and having a void volume Vv of less than 0.3 ml/m$^2$, and a surface waviness component including a multiplicity of asperities having a lower frequency than the surface roughness component and having a void volume Vv of not less than 0.05 ml/m$^2$ and not greater than 6 ml/m$^2$, the void volumes Vv being each defined as the sum Vvc+Vvv of a core void volume Vvc and a dale void volume Vvv. The production method includes the step of finishing the outer peripheral surface (5) into a surface geometry satisfying the aforementioned requirements for the void volumes Vv by at least one of laser processing, wet blasting and dry blasting after polishing the outer peripheral surface (5).

4 Claims, 6 Drawing Sheets

CHARGING ROLLER, AND METHOD OF PRODUCING THE SAME

TECHNICAL FIELD

The present invention relates to a charging roller to be used in an electrophotographic image forming apparatus, and to a method of producing the same.

BACKGROUND ART

In an electrophotographic image forming apparatus such as a laser printer, an electrostatic copying machine, a plain paper facsimile machine or a printer-copier-facsimile multifunction machine, a charging roller is used for uniformly electrically charging a surface of a photoreceptor body.

The charging roller typically includes a roller body having a single layer structure or a multilayer structure including a layer produced, for example, by forming a semiconductive rubber composition into a tubular body and then crosslinking a rubber of the rubber composition.

Incidentally, fine particles such as external additive particles externally added to toner or finely broken toner particles occurring when image formation is repeated are liable to adhere to and accumulate on an outer peripheral surface of the roller body, thereby causing imaging failure. For suppression of the imaging failure, it is a general practice to condition the outer peripheral surface, for example, by polishing the outer peripheral surface and/or coating the outer peripheral surface with a coating film after the polishing.

However, the coating film is formed by applying a liquid coating agent onto the outer peripheral surface of the roller body by a spraying method, a dipping method or other coating method, and then drying the applied liquid coating agent. Therefore, the coating film is liable to suffer from contamination with foreign matter such as dust in the formation thereof, uneven thickness and other defects.

For preparation of the coating agent, an organic solvent is required. The use of the organic solvent may exert a great load on the environment, and go against a recent trend toward reduction of VOC (volatile organic compounds).

It is also contemplated that various asperities which are supposed to prevent the adhesion and the accumulation of the fine particles are formed on the outer peripheral surface of the roller body, for example, by polishing the outer peripheral surface under properly controlled polishing conditions or processing the outer peripheral surface by a laser processing method, a blasting method or other processing method, rather than forming the coating film (see Patent Documents 1 to 4)

CITATION LIST

Patent Documents

[PATENT DOCUMENT 1] JP-2006-243374A
[PATENT DOCUMENT 2] JP-2006-243375A
[PATENT DOCUMENT 3] JP-2011-95725A
[PATENT DOCUMENT 4] JP-HEI11(1999)-194580A

SUMMARY OF INVENTION

Technical Problem

According to studies conducted by the inventor of the present invention, however, the aforementioned conventional charging roller fails to sufficiently suppress the adhesion and the accumulation of the fine particles. Further, the charging roller fails to uniformly electrically charge the surface of the photoreceptor body depending on its surface geometry, thereby reducing the image formation quality due to uneven charging.

It is an object of the present invention to provide a charging roller which has a simple construction without the provision of the coating film and yet is capable of uniformly electrically charging the surface of the photoreceptor body and more advantageously suppressing the adhesion and the accumulation of the fine particles, and to provide a method of producing the charging roller.

Solution to Problem

According to an inventive aspect, there is provided a charging roller including a roller body having an outer peripheral surface which includes a surface roughness component including a multiplicity of asperities and having a void volume Vv of less than 0.3 $ml/m^2$, and a surface waviness component including a multiplicity of asperities having a lower frequency than the surface roughness component and having a void volume Vv of not less than 0.05 $ml/m^2$ and not greater than 6 $ml/m^2$, the void volumes Vv being each defined as the sum Vvc+Vvv of a core void volume Vvc and a dale void volume Vvv specified by International Organization for Standardization ISO 25178-2:2012.

According to another inventive aspect, there is provided a method of producing the inventive charging roller, the method including the steps of: forming a roller body; polishing an outer peripheral surface of the roller body; and finishing the polished outer peripheral surface by at least one method selected from the group consisting of a laser processing method, a wet blasting method and a dry blasting method, so that the outer peripheral surface includes a surface roughness component having a void volume Vv of less than 0.3 $ml/m^2$, and a surface waviness component having a void volume Vv of not less than 0.05 $ml/m^2$ and not greater than 6 $ml/m^2$.

Effects of Invention

According to the present invention, the charging roller is provided which has a simple construction without the provision of the coating film and yet is capable of uniformly electrically charging the surface of the photoreceptor body and more advantageously suppressing the adhesion and the accumulation of the fine particles. The method of producing the charging roller is also provided.

DESCRIPTION OF EMBODIMENTS

Figure 1:
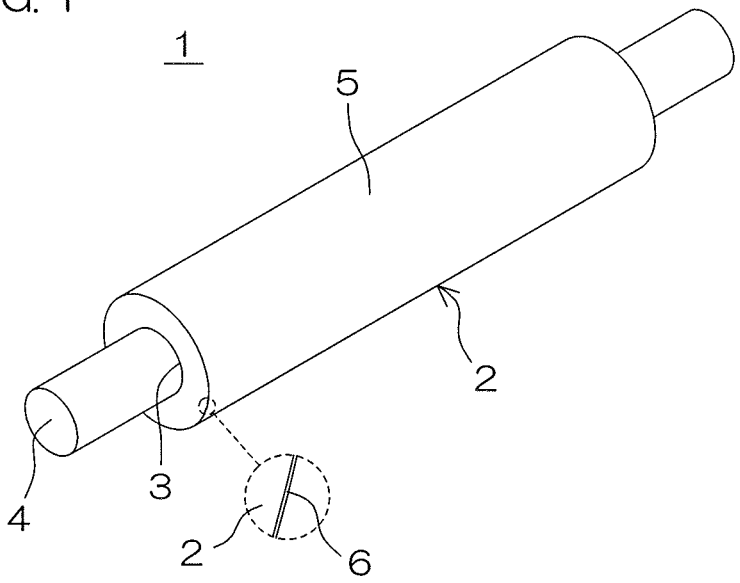
FIG. 1 is a perspective view showing an exemplary charging roller according to an embodiment of the present invention.

It is known that the outer peripheral surface of the roller body processed by any of the aforementioned various processing methods generally has a surface geometry such that a surface roughness component including a multiplicity of minute asperities and a surface waviness component including a multiplicity of asperities having a lower frequency than the surface roughness component, i.e., having greater depths and greater opening areas than the surface roughness component, overlap each other.

According to studies conducted by the inventor of the present invention, it is effective to minimize the number and the sizes of the asperities of the surface roughness component for suppression of the adhesion and the accumulation of the fine particles on the outer peripheral surface.

Further, the surface waviness component requires the following considerations:

(i) As the depths of concavities of the asperities of the surface waviness component are reduced, the fine particles are more liable to adhere to and accumulate on the outer peripheral surface. As the depths of the concavities are increased, the outer peripheral surface tends to have poorer smoothness, failing to uniformly electrically charge the surface of the photoreceptor body. Therefore, it is important to control the depths of the concavities of the asperities of the surface waviness component within a proper range.

(ii) If the opening areas of the concavities of the asperities of the surface waviness component are excessively small or excessively great, the fine particles are more liable to adhere to and accumulate on the outer peripheral surface. Therefore, it is important to control the opening areas of the concavities of the asperities of the surface waviness component within a proper range.

In order to provide a charging roller which is capable of uniformly electrically charging the surface of the photoreceptor body and more advantageously suppressing the adhesion and the accumulation of the fine particles as described above, the inventor of the present invention conducted studies to define the number and the sizes of the asperities of the surface roughness component and the depths and the opening areas of the concavities of the asperities of the surface waviness component with the use of new indexes of the surface geometry.

As a result, the inventor found that the surface roughness component preferably has a void volume Vv of less than 0.3 $ml/m^2$ and the surface waviness component preferably has a void volume Vv of not less than 0.05 $ml/m^2$ and not greater than 6 $ml/m^2$, wherein the void volume Vv of the surface roughness component and the void volume Vv of the surface waviness component are each defined as the sum Vvc+Vvv of a core void volume Vvc and a dale void volume Vvv specified by International Organization for Standardization ISO 25178-2:2012 "Geometrical product specifications (GPS)—Surface texture: Areal-Part 2: Terms, definitions and surface texture parameters."

If the void volume Vv of the surface roughness component is not less than 0.3 $ml/m^2$, the asperities of the surface roughness component are increased in number and size, whereby the fine particles are more liable to adhere to and accumulate on the outer peripheral surface of the roller body.

Where the void volume Vv of the surface roughness component is less than 0.3 $ml/m^2$, in contrast, the asperities of the surface roughness component are reduced in number and size, so that the adhesion and the accumulation of the fine particles can be advantageously suppressed.

If the void volume Vv of the surface waviness component is less than 0.05 $ml/m^2$, the concavities of the asperities of the surface waviness component are reduced in depth and/or opening area, whereby the fine particles are more liable to adhere to and accumulate on the outer peripheral surface of the roller body.

If the void volume Vv of the surface waviness component is greater than 6 $ml/m^2$, on the other hand, the concavities each have a greater depth, making it impossible to uniformly electrically charge the surface of the photoreceptor body. Further, the concavities each have a greater opening area, whereby the fine particles are more liable to adhere to and accumulate on the outer peripheral surface of the roller body.

Where the void volume Vv of the surface waviness component is not less than 0.05 $ml/m^2$ and not greater than 6 $ml/m^2$, in contrast, the depths and the opening areas of the concavities of the asperities of the surface waviness component can be controlled within proper ranges, making it possible to uniformly electrically charge the surface of the photoreceptor body and advantageously suppress the adhesion and the accumulation of the fine particles on the outer peripheral surface of the roller body.

For further improvement of the aforementioned effects, the void volume Vv of the surface roughness component is preferably not less than 0.1 $ml/m^2$ and not greater than 0.28 $ml/m^2$ in the aforementioned range, and the void volume Vv of the surface waviness component is preferably not less than 0.1 $ml/m^2$ and not greater than 4 $ml/m^2$ in the aforementioned range.

In the present invention, the surface geometry of the outer peripheral surface of the roller body is measured by means of a geometry analyzing laser microscope, and the void volumes Vv of the surface roughness component and the surface waviness component are calculated based on the result of the measurement in conformity with the aforementioned ISO standard in the following manner.

For determination of the void volume Vv of the surface roughness component, the measurement result (real surface) is smoothed by means of a median filter, then corrected for surface tilt, and further subjected to planar correction (waviness removal correction) for removal of the surface waviness component. Thus, a scale-limited surface is obtained.

Subsequently, a predetermined evaluation area is specified on the scale-limited surface, and a reference surface is determined for the scale-limited surface. A core void volume Vvc (a difference between a void volume at an areal material ratio p % and a void volume at an areal material ratio q %) and a dale void volume Vvv at the areal material ratio p % are computed.

Then, the sum Vvc+Vvv of these volumes is calculated, and defined as the void volume Vv of the surface roughness component.

For determination of the void volume Vv of the surface waviness component, the measurement result (real surface) is processed by means of a low pass filter for removal of a high frequency component (surface roughness component), then smoothed by means of a median filter, and corrected for surface tilt. Thus, a scale-limited surface is obtained.

Subsequently, a predetermined evaluation area is specified on the scale-limited surface, and a reference surface is determined for the scale-limited surface. A core void volume Vvc (a difference between a void volume at an areal material ratio p % and a void volume at an areal material ratio q %) and a dale void volume Vvv at the areal material ratio p % are computed.

Then, the sum Vvc+Vvv of these volumes is calculated, and defined as the void volume Vv of the surface waviness component.

For the determination of the void volumes Vv of the surface roughness component and the surface waviness component, the areal material ratio p % is generally set to 80%, and the areal material ratio q % is generally set to 10%.

The specific dimensions of the concavities of the asperities of the surface waviness component having the aforementioned void volume Vv are not particularly limited, but the concavities each preferably have a depth of not less than 1 μm and not greater than 50 μm. Further, the concavities each preferably have an opening area of not less than 1 $\mu m^2$ and not greater than 1 $mm^2$.

The outer peripheral surface of the roller body preferably has an arithmetic mean height Sa (the extension of a line-profile arithmetic mean height Ra to surface profile) of not less than 0.8 μm and not greater than 3 μm as measured in conformity with the aforementioned ISO standard.

<<Charging Roller and Charging Roller Production Method>>

FIG. 1 is a perspective view showing an exemplary charging roller according to an embodiment of the present invention.

Referring to FIG. 1, the charging roller 1 according to this embodiment includes a tubular roller body 2 of a nonporous single-layer structure formed from an semiconductive rubber composition. A shaft 4 is inserted through and fixed to a center through-hole 3 of the roller body 2.

The shaft 4 is a unitary member made of a metal such as aluminum, an aluminum alloy or a stainless steel.

The shaft 4 is electrically connected to and mechanically fixed to the roller body 2, for example, via an electrically conductive adhesive agent. Alternatively, a shaft having an outer diameter that is greater than the inner diameter of the through-hole 3 is used as the shaft 4, and press-inserted into the through-hole 3 to be electrically connected to and mechanically fixed to the roller body 2.

The roller body 2 has an oxide film 6 formed in an outer peripheral surface 5 thereof as shown in FIG. 1 on an enlarged scale.

The oxide film 6 thus formed functions as a dielectric layer to reduce the dielectric dissipation factor of the charging roller 1. Further, the oxide film 6 serves as a lower friction layer which further advantageously suppresses the adhesion of the fine particles.

In addition, the oxide film 6 can be easily formed through oxidation of rubber present in the outer peripheral surface 5, for example, by irradiating the outer peripheral surface 5 with ultraviolet radiation in an oxidizing atmosphere. This suppresses the reduction in the productivity of the charging roller 1 and the increase in the production costs of the charging roller 1.

The term "single-layer structure" for the roller body 2 herein means that the roller body 2 includes a single layer formed from the rubber or the like and the oxide film 6 formed by the irradiation with the ultraviolet radiation or the like is not counted.

For production of the charging roller 1, a prepared rubber composition is first extruded into a tubular body by means of an extruder, and the tubular body is cut to a predetermined length. Then, the rubber of the tubular body is crosslinked in a vulcanization can by pressure and heat.

In turn, the crosslinked tubular body is heated in an oven or the like to be thereby secondarily crosslinked, and cooled. Then, the outer peripheral surface 5 is polished to a predetermined outer diameter.

Various polishing methods such as a dry traverse polishing method are usable for the polishing.

Subsequently, the outer peripheral surface 5 thus polished is finished into a specific surface geometry satisfying the requirements for the void volumes Vv of the surface roughness component and the surface waviness component described above by at least one processing method selected from the group consisting of a laser processing method, a wet blasting method and a dry blasting method. Thus, the roller body 2 is produced.

That is, the outer peripheral surface 5 simply polished is in such a state that a greater number of greater size asperities are present to define the surface roughness component.

The outer peripheral surface 5 in this state is formed with lower frequency asperities of the surface waviness component by the laser processing method or the wet or dry blasting method, whereby the minute asperities of the surface roughness component are reduced in size and number. Thus, the roller body 2 is produced as having the outer peripheral surface 5 satisfying the specific surface geometry described above.

Where the void volume Vv of the surface waviness component of the outer peripheral surface 5 is to be set to less than 1 $ml/m^2$, particularly not greater than 0.5 $ml/m^2$ in the aforementioned range, for example, the outer peripheral surface 5 is preferably first polished by the dry traverse polishing method or the like, then finished by a mirror polishing method or the like, and processed by the laser processing method or the wet or dry blasting method.

In the laser processing method, the polished outer peripheral surface 5 is irradiated with a laser beam narrowed to a predetermined irradiation spot size by moving the irradiation spot of the laser beam at a predetermined pitch.

In the laser processing method, the crosslinked rubber composition present in the outer peripheral surface 5 is selectively fused and at least partly evaporated by heat generated by the irradiation with the laser beam, whereby the outer peripheral surface 5 is formed with a multiplicity of asperities of the surface waviness component.

Where the outer peripheral surface of the roller body is processed into the specific surface geometry described above by the laser processing method, for example, the laser output, the irradiation spot size and the irradiation spot movement pitch of the laser beam to be applied to the outer peripheral surface, the overlapping degree of adjacent irradiation spots, and/or the like may be properly controlled.

In the laser processing method, the void volume Vv of the surface waviness component can be reduced, for example, by reducing the irradiation spot movement pitch.

The pitch may be set within a given range that permits the formation of the specific surface geometry, but is preferably not less than 30 μm and not greater than 60 μm, more preferably not less than 35 μm, particularly preferably not less than 40 μm.

The laser processing method is particularly advantageous, for example, when the void volume Vv of the surface waviness component of the outer peripheral surface 5 is to be set to not less than 1 $ml/m^2$ in the aforementioned range.

In the wet blasting method, the polished outer peripheral surface 5, preferably the mirror-polished outer peripheral surface 5, is blasted with a slurry (containing fine abrasive particles and liquid such as water) ejected at a high speed from a jet nozzle. In the dry blasting method, the outer peripheral surface 5 is blasted with fine abrasive particles and compressed gas such as compressed air ejected at a high speed from a jet nozzle.

In the blasting, the crosslinked rubber composition present in the outer peripheral surface 5 is selectively polished away by the blasting with the fine abrasive particles, whereby the outer peripheral surface 5 is formed with a multiplicity of asperities of the surface waviness component.

Where the outer peripheral surface of the roller body is to be processed into the specific surface geometry described above by the blasting, for example, the type, the particle shapes and the particle diameters of the fine abrasive particles to be used for the blasting of the outer peripheral surface, the blasting pressure and the blasting period for the blasting with the fine particles, and/or the like may be properly controlled.

In the blasting, the void volumes Vv of the surface roughness component and the surface waviness component can be reduced, for example, by increasing the blasting period, if the type, the particle shapes and the particle diameters of the fine particles, the blasting pressure and the like are constant.

Where the mirror polishing precedes the blasting, a wrapping film having a smaller mesh may be used for the mirror polishing to reduce the void volumes Vv of the surface roughness component and the surface waviness component observed after the blasting.

The wet blasting method and the dry blasting method are particularly advantageous, for example, when the void volume Vv of the surface waviness component of the outer peripheral surface 5 is to be set to less than 1 $ml/m^2$, particularly not greater than 0.5 $ml/m^2$, in the aforementioned range.

The shaft 4 may be inserted through and fixed to the through-hole 3 at any time between the cutting of the tubular body and the end of the finishing of the roller body.

However, the tubular body is preferably subjected to the secondary crosslinking, the polishing and the finishing with the shaft 4 inserted through the through-hole 3 after the cutting. This prevents warpage and deformation of the roller body 2 which may otherwise occur due to expansion and contraction of the tubular body in the secondary crosslinking. Further, the tubular body may be polished and finished while being rotated about the shaft 4. This improves the working efficiency in the polishing and the finishing, and suppresses deflection of the outer peripheral surface 5.

As previously described, the shaft 4 having an outer diameter greater than the inner diameter of the through-hole 3 may be press-inserted into the through-hole 3, or the shaft 4 may be inserted through the through-hole 3 with the intervention of an electrically conductive thermosetting adhesive agent before the secondary crosslinking.

In the former case, the electrical connection and the mechanical fixing are achieved simultaneously with the press insertion of the shaft 4.

In the latter case, the thermosetting adhesive agent is cured when the tubular body is secondarily crosslinked by the heating in the oven. Thus, the shaft 4 is electrically connected to and mechanically fixed to the roller body 2.

As previously described, the formation of the oxide film 6 is preferably achieved by irradiating the outer peripheral surface 5 of the roller body 2 with the ultraviolet radiation. This method is simple and efficient, because the formation of the oxide film 6 is achieved through the oxidation of the rubber present in the outer peripheral surface 5 by irradiating the outer peripheral surface 5 with ultraviolet radiation having a predetermined wavelength for a predetermined period after the laser processing or the like.

In addition, the oxide film 6 formed by the irradiation with the ultraviolet radiation is free from the problems associated with the conventional film formation method in which a coating film is formed by applying a coating agent, and is highly uniform in thickness and excellent in adhesion to the roller body 2.

The wavelength of the ultraviolet radiation to be used for the irradiation is preferably not less than 100 nm and not greater than 400 nm, particularly preferably not greater than 300 nm, for efficient oxidation of the rubber in the rubber composition and for the formation of the oxide film 6 excellent in the aforementioned functions. The irradiation period is preferably not shorter than 30 seconds and not longer than 30 minutes, particularly preferably not shorter than 1 minute and not longer than 20 minutes.

The oxide film 6 may be formed by other method, or may be obviated in some case.

<<Rubber Composition>>

The rubber composition for the roller body is prepared by blending a rubber component, a crosslinking component for crosslinking the rubber component, and additives.

(Rubber Component)

The rubber component of the rubber composition preferably includes an ion-conductive rubber for controlling the roller resistance of the charging roller within a proper range. An example of the ion conductive rubber is epichlorohydrin rubber.

The rubber component preferably includes diene rubber together with the ion-conductive rubber in order to impart the rubber composition with proper processability and improve the mechanical strength and the durability of the roller body, or to impart the roller body with proper rubber characteristic properties, i.e., to make the roller body flexible and less susceptible to permanent compressive deformation with a reduced compression set.

(Epichlorohydrin Rubber)

Various ion-conductive polymers each containing epichlorohydrin as a repeating unit are usable as the epichlorohydrin rubber.

Examples of the epichlorohydrin rubber include epichlorohydrin homopolymers, epichlorohydrin-ethylene oxide bipolymers (ECO), epichlorohydrin-propylene oxide bipolymers, epichlorohydrin-allyl glycidyl ether bipolymers, epichlorohydrin-ethylene oxide-allyl glycidyl ether terpolymers (GECO), epichlorohydrin-propylene oxide-allyl glycidyl ether terpolymers and epichlorohydrin-ethylene oxide-propylene oxide-allyl glycidyl ether quaterpolymers, which may be used alone or in combination.

Of these epichlorohydrin rubbers, the ethylene oxide-containing copolymers, particularly the ECO and/or the GECO are preferred for reducing the roller resistance of the charging roller to the proper range.

These copolymers preferably each have an ethylene oxide content of not less than 30 mol % and not greater than 80 mol %, particularly preferably not less than 50 mol %.

Ethylene oxide functions to reduce the roller resistance of the charging roller. If the ethylene oxide content is less than the aforementioned range, however, it will be impossible to sufficiently provide this function and hence to sufficiently reduce the roller resistance.

If the ethylene oxide content is greater than the aforementioned range, on the other hand, ethylene oxide is liable to be crystallized, whereby the segment motion of molecular chains is hindered to adversely increase the roller resistance of the charging roller. Further, the roller body is liable to have an excessively high hardness after the crosslinking, and the rubber composition is liable to have a higher viscosity and, hence, poorer processability when being heat-melted before the crosslinking.

The ECO has an epichlorohydrin content that is a balance obtained by subtracting the ethylene oxide content from the total. That is, the epichlorohydrin content is preferably not less than 20 mol % and not greater than 70 mol %, particularly preferably not greater than 50 mol %.

The GECO preferably has an allyl glycidyl ether content of not less than 0.5 mol % and not greater than 10 mol %, particularly preferably not less than 2 mol % and not greater than 5 mol %.

Allyl glycidyl ether per se functions as side chains of the copolymer to provide a free volume, whereby the crystallization of ethylene oxide is suppressed to reduce the roller resistance of the charging roller. However, if the allyl glycidyl ether content is less than the aforementioned range, it will be impossible to provide this function and hence to sufficiently reduce the roller resistance.

Allyl glycidyl ether also functions as crosslinking sites during the crosslinking of the GECO. Therefore, if the allyl glycidyl ether content is greater than the aforementioned range, the crosslinking density of the GECO is excessively increased, whereby the segment motion of molecular chains is hindered to adversely increase the roller resistance.

The GECO has an epichlorohydrin content that is a balance obtained by subtracting the ethylene oxide content and the allyl glycidyl ether content from the total. That is, the epichlorohydrin content is preferably not less than 10 mol % and not greater than 69.5 mol %, particularly preferably not less than 19.5 mol % and not greater than 60 mol %.

Examples of the GECO include copolymers of the three comonomers described above in a narrow sense, as well as known modification products obtained by modifying an epichlorohydrin-ethylene oxide copolymer (ECO) with allyl glycidyl ether. In the present invention, any of these modification products may be used as the GECO.

These epichlorohydrin rubbers may be used alone or in combination.

(Diene Rubber)

As described above, the diene rubber functions to impart the rubber composition with proper processability, to improve the mechanical strength and the durability of the roller body, or to impart the roller body with proper rubber characteristic properties, i.e., to make the roller body flexible and less susceptible to permanent compressive deformation with a reduced compression set.

Further, the diene rubber serves as a material to be oxidized by the irradiation with the ultraviolet radiation, as described above, to form the oxide film in the outer peripheral surface of the roller body.

Examples of the diene rubber include natural rubber, isoprene rubber (IR), butadiene rubber (BR), styrene butadiene rubber (SBR), chloroprene rubber (CR) and acrylonitrile butadiene rubber (NBR), which may be used alone or in combination.

Of these diene rubbers, the CR and the NBR are preferably used in combination.

That is, the three types of rubbers, i.e., the epichlorohydrin rubber, the CR and the NBR, are preferably used in combination as the rubber component. Two or more different grades of each of these three rubbers may be used in combination.

Where these rubbers are used in combination, the CR, which contains a great number of chlorine atoms in its molecule, has a function to improve the charging properties of the charging roller in addition to a function as the diene rubber. Further, the CR is a polar rubber and, therefore, functions to finely control the roller resistance of the charging roller.

The CR is synthesized by emulsion polymerization of chloroprene, and is classified in a sulfur modification type or a non-sulfur-modification type depending on the type of a molecular weight adjusting agent to be used for the emulsion polymerization.

The sulfur modification type CR is synthesized by plasticizing a copolymer of chloroprene and sulfur (molecular weight adjusting agent) with thiuram disulfide or the like to adjust the viscosity of the copolymer to a predetermined viscosity level.

The non-sulfur-modification type CR is classified, for example, in a mercaptan modification type, a xanthogen modification type or the like.

The mercaptan modification type CR is synthesized in substantially the same manner as the sulfur modification type CR, except that an alkyl mercaptan such as n-dodecyl mercaptan, tert-dodecyl mercaptan or octyl mercaptan, for example, is used as the molecular weight adjusting agent.

The xanthogen modification type CR is also synthesized in substantially the same manner as the sulfur modification type CR, except that an alkyl xanthogen compound is used as the molecular weight adjusting agent.

Further, the CR is classified in a lower crystallization speed type, an intermediate crystallization speed type or a higher crystallization speed type depending on the crystallization speed.

In the present invention, any of the aforementioned types of CRs may be used. Particularly, a CR of the non-sulfur-modification type and the lower crystallization speed type is preferred.

Further, a copolymer of chloroprene and other comonomer may be used as the CR. Examples of the other comonomer include 2,3-dichloro-1,3-butadiene, 1-chloro-1,3-butadiene, styrene, acrylonitrile, methacrylonitrile, isoprene, butadiene, acrylic acid, acrylates, methacrylic acid and methacrylates, which may be used alone or in combination.

Further, the CRs include those of an oil-extension type having flexibility controlled by addition of an extension oil, and those of a non-oil-extension type containing no extension oil. In the present invention, a non-oil-extension type CR which does not contain the extension oil (which may be a bleed substance) is preferably used for the prevention of the contamination of the photoreceptor body.

These CRs may be used alone or in combination.

The NBR has excellent functions as the diene rubber. The NBR is a polar rubber and, therefore, functions to finely control the roller resistance of the charging roller.

A lower acrylonitrile content type NBR having an acrylonitrile content of not greater than 24%, an intermediate acrylonitrile content type NBR having an acrylonitrile content of 25 to 30%, an intermediate to higher acrylonitrile content type NBR having an acrylonitrile content of 31 to 35%, a higher acrylonitrile content type NBR having an acrylonitrile content of 36 to 42% and a very high acrylonitrile content type NBR having an acrylonitrile content of not less than 43% are usable as the NBR.

The NBRs include those of an oil-extension type having flexibility controlled by addition of an extension oil, and those of a non-oil-extension type containing no extension oil. In the present invention, a non-oil-extension type NBR which does not contain the extension oil (which may be a bleed substance) is preferably used for the prevention of the contamination of the photoreceptor body.

These NBRs may be used alone or in combination.

(Proportions of Rubbers for Rubber Component)

The proportions of the rubbers for the rubber component may be determined according to required characteristic properties of the charging roller, particularly, the roller resistance of the charging roller, the flexibility of the roller body, and the like.

However, the proportion of the epichlorohydrin rubber to be blended is preferably not less than 15 parts by mass and not greater than 80 parts by mass, particularly preferably not less than 30 parts by mass and not greater than 70 parts by mass, based on 100 parts by mass of the overall rubber component.

If the proportion of the epichlorohydrin rubber is less than the aforementioned range, it will be impossible to sufficiently reduce the roller resistance of the charging roller to the proper range.

If the proportion of the epichlorohydrin rubber is greater than the aforementioned range, on the other hand, the proportion of the diene rubber is relatively reduced, making it impossible to impart the rubber composition with proper processability, to impart the roller body with the proper rubber characteristic properties or to continuously form the oxide film having the aforementioned function in the outer peripheral surface.

Where the proportion of the epichlorohydrin rubber falls within the aforementioned range, in contrast, it is possible to sufficiently reduce the roller resistance of the charging roller to the proper range while providing the aforementioned effect of the combinational use of the epichlorohydrin rubber and the diene rubber.

The proportion of the CR to be blended is preferably not less than 5 parts by mass and not greater than 30 parts by mass, particularly preferably not greater than 20 parts by mass, based on 100 parts by mass of the overall rubber component.

If the proportion of the CR is less than the aforementioned range, it will be impossible to sufficiently provide the aforementioned effects of the blending of the CR, i.e., for improving the charging properties of the charging roller and for finely controlling the roller resistance.

If the proportion of the CR is greater than the aforementioned range, on the other hand, the proportion of the epichlorohydrin rubber is relatively reduced, making it impossible to sufficiently reduce the roller resistance of the charging roller to the proper range.

The proportion of the NBR to be blended is a balance obtained by subtracting the proportions of the epichlorohydrin rubber and the CR from the total. That is, the proportion of the NBR is determined so that the predetermined proportions of the epichlorohydrin rubber and the CR plus the proportion of the NBR equal to 100 parts by mass of the overall rubber component.

<Crosslinking Component>

A thiourea crosslinking agent and a sulfur crosslinking agent are preferably used in combination as the crosslinking component.

(Thiourea Crosslinking Agent)

Any of various thiourea compounds each having a thiourea structure in a molecule thereof and functioning as a crosslinking agent for the ECO and/or the GECO may be used as the thiourea crosslinking agent.

Examples of the thiourea crosslinking agent include ethylene thiourea, N,N-diphenylthiourea, trimethylthiourea, thioureas represented by $(C_nH_{2n+1}NH)_2C{=}S$ (wherein n is a number of 1 to 12) and tetramethylthiourea, which may be used alone or in combination. Particularly, ethylene thiourea is preferred.

The proportion of the thiourea crosslinking agent to be blended is preferably not less than 0.1 part by mass and not greater than 1 part by mass based on 100 parts by mass of the overall rubber component in order to impart the roller body with the proper rubber characteristic properties as described above.

(Crosslinking Accelerating Agent)

Any of various crosslinking accelerating agents capable of accelerating the crosslinking reaction of the ECO and/or the GECO with the thiourea crosslinking agent may be used in combination with the thiourea crosslinking agent.

Examples of the crosslinking accelerating agents include guanidine accelerating agents such as 1,3-diphenylguanidine, 1,3-di-o-tolylguanidine and 1-o-tolylbiguanide, which may be used alone or in combination. Particularly, 1,3-di-o-tolylguanidine is preferred.

The proportion of the crosslinking accelerating agent to be blended is preferably not less than 0.1 part by mass and not greater than 1 part by mass based on 100 parts by mass of the overall rubber component in order to sufficiently provide the crosslinking reaction accelerating effect.

(Sulfur Crosslinking Agent)

Examples of the sulfur crosslinking agent for mainly crosslinking the diene rubber and the GECO include sulfur such as sulfur powder, oil-treated sulfur powder, precipitated sulfur, colloidal sulfur and dispersive sulfur, and organic sulfur-containing compounds such as tetramethylthiuram disulfide and N,N-dithiobismorpholine. Particularly, the sulfur is preferred.

The proportion of the sulfur to be blended is preferably not less than 1 part by mass and not greater than 2 parts by mass based on 100 parts by mass of the overall rubber component in order to impart the roller body with the proper rubber characteristic properties as described above.

Where the oil-treated sulfur powder or the dispersive sulfur is used as the sulfur, for example, the proportion of the sulfur is the effective proportion of sulfur contained in the oil-treated sulfur powder or the dispersive sulfur.

Where an organic sulfur-containing compound is used as the crosslinking agent, the proportion of the organic sulfur-containing compound is preferably adjusted so that the proportion of sulfur contained in the molecule of the organic sulfur-containing compound falls within the aforementioned range based on 100 parts by mass of the overall rubber component.

(Crosslinking Accelerating Agent)

Any of various crosslinking accelerating agents capable of accelerating the crosslinking reaction of the diene rubber and the like with the sulfur crosslinking agent may be used in combination with the sulfur crosslinking agent.

Examples of the crosslinking accelerating agent include a thiazole accelerating agent, a thiuram accelerating agent, a sulfenamide accelerating agent and a dithiocarbamate accelerating agent, which may be used alone or in combination. Particularly, the thiazole accelerating agent and the thiuram accelerating agent are preferably used in combination.

Examples of the thiazole accelerating agent include 2-mercaptobenzothiazole, di-2-benzothiazolyl disulfide, a zinc salt of 2-mercaptobenzothiazole, a cyclohexylamine salt of 2-mercaptobenzothiazole, 2-(N,N-diethylthiocarbamoylthio)benzothiazole and 2-(4'-morpholinodithio)benzothiazole, which may be used alone or in combination. Particularly, di-2-benzothiazolyl disulfide is preferred.

Examples of the thiuram accelerating agent include tetramethylthiuram monosulfide, tetramethylthiuram disulfide, tetraethylthiuram disulfide, tetrabutylthiuram disulfide, tetrakis(2-ethylhexyl)thiuram disulfide and dipentamethylenethiuram tetrasulfide, which may be used alone or in combination. Particularly, tetramethylthiuram monosulfide is preferred.

Where the aforementioned two types of crosslinking accelerating agents are used in combination, the proportion of the thiazole accelerating agent to be blended is preferably not less than 1 part by mass and not greater than 2 parts by mass based on 100 parts by mass of the overall rubber component in order to sufficiently provide the crosslinking reaction accelerating effect. Further, the proportion of the thiuram accelerating agent to be blended is preferably not less than 0.1 part by mass and not greater than 1 part by mass based on 100 parts by mass of the overall rubber component.

<Electrically Conductive Agent>

A salt (ionic salt) containing an anion having a fluoro group and a sulfonyl group and a cation in its molecule may be further blended as an electrically conductive agent in the rubber composition.

The blending of the ionic salt as the electrically conductive agent makes it possible to further improve the ion conductivity of the rubber composition to further reduce the roller resistance of the charging roller.

Examples of the anion having the fluoro group and the sulfonyl group in the molecule of the ionic salt include fluoroalkyl sulfonate ions, bis(fluoroalkylsulfonyl)imide ions and tris(fluoroalkylsulfonyl)methide ions, which may be used alone or in combination.

Examples of the fluoroalkyl sulfonate ions include $CF_3SO_3^-$ and $C_4F_9SO_3^-$, which may be used alone or in combination.

Examples of the bis(fluoroalkylsulfonyl)imide ions include $(CF_3SO_2)_2N^-$, $(C_2F_5SO_2)_2N^-$, $(C_4F_9SO_2)(CF_3SO_2)N^-$, $(FSO_2C_6F_4)(CF_3SO_2)N^-$, $(C_6F_{17}SO_2)(CF_3SO_2)N^-$, $(CF_3CH_2OSO_2)_2N^-$, $(CF_3CF_2CH_2OSO_2)_2N^-$, $(HCF_2CF_2CH_2OSO_2)_2N^-$ and $[(CF_3)_2CHOSO_2]_2N^-$, which may be used alone or in combination.

Examples of the tris(fluoroalkylsulfonyl)methide ions include $(CF_3SO_2)_3C^-$ and $(CF_3CH_2OSO_2)_3C^-$ which may be used alone or in combination.

Examples of the cation include ions of alkali metals such as sodium, lithium and potassium, ions of Group II elements such as beryllium, magnesium, calcium, strontium and barium, ions of transition elements, cations of amphoteric elements, a quaternary ammonium ion and an imidazolium cation, which may be used alone or in combination.

Particularly, lithium salts containing the lithium ion as the cation and potassium salts containing the potassium ion as the cation are preferred as the ionic salt.

Particularly, $(CF_3SO_2)_2NLi$ (lithium bis(trifluoromethanesulfonyl)imide, Li-TFSI) and/or $(CF_3SO_2)_2NK$ (potassium bis(trifluoromethanesulfonyl)imide, K-TFSI) are preferred to improve the ion conductivity of the rubber composition to reduce the roller resistance of the charging roller.

The proportion of the ionic salt to be blended is preferably not less than 0.5 parts by mass and not greater than 5 parts by mass based on 100 parts by mass of the overall rubber component.

<Other Ingredients>

As required, various additives may be blended in the rubber composition. Examples of the additives include a crosslinking acceleration assisting agent, an acid accepting agent, a filler, a plasticizing agent, a processing aid and a degradation preventing agent.

Examples of the crosslinking acceleration assisting agent include metal compounds such as zinc oxide (zinc white), fatty acids such as stearic acid, oleic acid and cotton seed fatty acids, and other conventionally known crosslinking acceleration assisting agents, which may be used alone or in combination.

The proportions of these crosslinking acceleration assisting agents to be blended are each preferably not less than 0.1 part by mass and not greater than 7 parts by mass based on 100 parts by mass of the overall rubber component.

In the presence of the acid accepting agent, chlorine-containing gases generated from the epichlorohydrin rubber and the CR during the crosslinking of the rubber component are prevented from remaining in the roller body. Thus, the acid accepting agent functions to prevent the inhibition of the crosslinking and the contamination of the photoreceptor body, which may otherwise be caused by the chlorine-containing gases.

Any of various substances serving as acid acceptors may be used as the acid accepting agent. Preferred examples of the acid accepting agent include hydrotalcites and Magsarat which are excellent in dispersibility. Particularly, the hydrotalcites are preferred.

Where the hydrotalcites are used in combination with magnesium oxide or potassium oxide, a higher acid accepting effect can be provided, thereby more reliably preventing the contamination of the photoreceptor body.

The proportion of the acid accepting agent to be blended is preferably not less than 0.1 part by mass and not greater than 7 parts by mass based on 100 parts by mass of the overall rubber component.

Examples of the filler include zinc oxide, silica, carbon black, clay, talc, calcium carbonate, magnesium carbonate and aluminum hydroxide, which may be used alone or in combination.

The blending of the filler improves the mechanical strength and the like of the charging roller.

Where electrically conductive carbon black is used as the filler, it is possible to impart the roller body with electron conductivity.

An example of the electrically conductive carbon black is acetylene black.

The proportion of the electrically conductive carbon black to be blended is preferably not less than 1 part by mass and not greater than 7 parts by mass based on 100 parts by mass of the overall rubber component.

Examples of the plasticizing agent include plasticizers such as dibutyl phthalate, dioctyl phthalate and tricresyl phosphate, and waxes such as polar waxes. Examples of the processing aid include metal salts of fatty acids such as zinc stearate.

The proportion of the plasticizing agent and/or the processing aid to be blended is preferably not greater than 3 parts by mass based on 100 parts by mass of the overall rubber component.

Examples of the degradation preventing agent include various antiaging agents and antioxidants.

The antiaging agents serve to reduce the environmental dependence of the roller resistance of the charging roller and to suppress the increase in roller resistance during continuous energization of the charging roller. Examples of the antiaging agents include nickel diethyldithiocarbamate and nickel dibutyldithiocarbamate.

The proportion of the antiaging agent to be blended is preferably not less than 0.1 part by mass and not greater than 1 part by mass based on 100 parts by mass of the overall rubber component.

Other examples of the additives include an anti-scorching agent, a lubricant, a pigment, an antistatic agent, a flame retarder, a neutralizing agent, a nucleating agent and a co-crosslinking agent, which may be each blended in a proper proportion.

In the embodiment shown in FIG. 1, the roller body is illustrated as having a single layer structure including a layer made of a crosslinked product of the rubber composition containing the aforementioned ingredients, but may have a multilayer structure having two or more layers including the layer made of the crosslinked product of the rubber composition.

The roller body is not limited to that formed from the rubber composition described above.

The roller body may be formed from any of various materials which satisfy requirements such as to impart the charging roller with a proper roller resistance, to impart the roller body with higher mechanical strength and higher durability, and to make the roller body flexible and less susceptible to the permanent compressive deformation with a reduced compression set.

In either case, the outer peripheral surface of the roller body is formed with the specific surface geometry described above, whereby the charging roller has a simple construction without the provision of the coating film and yet is capable of uniformly electrically charging the surface of the photoreceptor body and more advantageously suppressing the adhesion and the accumulation of the fine particles.

The inventive charging roller can be incorporated in various electrophotographic image forming apparatuses such as a laser printer, an electrostatic copying machine, a plain paper facsimile machine and a printer-copier-facsimile multifunction machine.

EXAMPLES

The present invention will hereinafter be described in greater detail by way of inventive examples and comparative examples. It should be understood that the invention be not necessarily limited to these examples.

Void volumes Vv of a surface roughness component and a surface waviness component of an outer peripheral surface of a roller body of each of charging rollers produced in the inventive examples and the comparative examples were determined in the following manner based on the result of measurement of the surface geometry of the outer peripheral surface performed with respect to an observation area of 55625 $\mu m^2$ by means of a geometry analyzing laser microscope (VK-X150/160 available from Keyence Corporation).

(Void Volume Vv of Surface Roughness Component)

The measurement result (real surface) of the surface geometry of the outer peripheral surface obtained by using the aforementioned geometry analyzing laser microscope was smoothed by means of a median filter (3×3), then corrected for surface tilt, and further subjected to planar correction (waviness removal correction) at an intensity of 20 twice for removal of the surface waviness component. Thus, a scale-limited surface was obtained.

Subsequently, a predetermined evaluation area was specified on the scale-limited surface, and a reference surface was determined for the scale-limited surface. A core void volume Vvc (a difference between a void volume at an areal material ratio p of 80% and a void volume at an areal material ratio q of 10%) and a dale void volume Vvv at an areal material ratio p of 80% were computed.

Then, the sum Vvc+Vvv of these volumes was calculated, which was defined as a void volume Vv of the surface roughness component. A charging roller having an outer peripheral surface having a surface roughness component void volume Vv of not less than 0.3 $ml/m^2$ was rated as unacceptable (x), and a charging roller having an outer peripheral surface having a surface roughness component void volume Vv of less than 0.3 $ml/m^2$ was rated as acceptable (○).

<Void Volume Vv of Surface Waviness Component>

The measurement result (real surface) of the surface geometry of the outer peripheral surface obtained by using the aforementioned geometry analyzing laser microscope was processed by means of a low pass filter (25 μm) for removal of a high frequency component (surface roughness component), then smoothed by means of a median filter (3×3), and further corrected for surface tilt. Thus, a scale-limited surface was obtained.

Subsequently, a predetermined evaluation area was specified on the scale-limited surface, and a reference surface was determined for the scale-limited surface. A core void volume Vvc (a difference between a void volume at an areal material ratio p of 80% and a void volume at an areal material ratio q of 10%) and a dale void volume Vvv at an areal material ratio p of 80% were computed.

Then, the sum Vvc+Vvv of these volumes was calculated, which was defined as a void volume Vv of the surface waviness component. A charging roller having an outer peripheral surface having a surface waviness component void volume Vv of less than 0.05 $ml/m^2$ or greater than 6 $ml/m^2$ was rated as unacceptable (x), and a charging roller having an outer peripheral surface having a surface waviness component void volume Vv of not less than 0.05 $ml/m^2$ and not greater than 6 $ml/m^2$ was rated as acceptable (○).

<Depth of Concavities>

Based on the data of the scale-limited surface (surface waviness component) obtained in the computation of the surface waviness component void volume Vv, an average depth (μm) of the concavities of the asperities of the surface waviness component as analyzed axially of the roller body was determined.

<Arithmetic Mean Height Sa>

The measurement result (real surface) of the surface geometry of the outer peripheral surface obtained by using the aforementioned geometry analyzing laser microscope was corrected for surface tilt, and further subjected to planar correction. Thus, a scale-limited surface was obtained.

Subsequently, a predetermined evaluation area was specified on the scale-limited surface, and an average of absolute values of height differences at respective points with respect to the scale-limited surface in the evaluation area was calculated, which was defined as an arithmetic mean height Sa (μm).

Example 1

A rubber component was prepared by blending 15 parts by mass of ECO (EPICHLOMER (registered trade name) D available from Osaka Soda Co., Ltd. and having an EO/EP molar ratio of 61/39, 45 parts by mass of GECO (EPION (registered trade name) 301 available from Osaka Soda Co., Ltd. and having a EO/EP/AGE molar ratio of 73/23/4, 10 parts by mass of CR (non-oil extension type, SHOPRENE (registered trade name) WRT available from Showa Denko K.K.) and 30 parts by mass of NBR (lower acrylonitrile content NBR of non-oil extension type, JSR N250 SL available from JSR Co., Ltd. and having an acrylonitrile content of 20%).

While 100 parts by mass of the rubber component including the four types of rubbers was simply kneaded by means of a Banbury mixer, the following ingredients were added to and kneaded with the rubber component.

TABLE 1

| Ingredients | Parts by mass |
|---|---|
| Ionic salt | 3.40 |
| Crosslinking acceleration assisting agent | 5.00 |
| Acid accepting agent | 5.00 |
| Filler | 2.00 |
| Processing aid | 1.00 |
| Antiaging agent | 0.50 |

The ingredients shown in Table 1 are as follows. The amounts (parts by mass) shown in Table 1 are based on 100 parts by mass of the overall rubber component. Ionic salt: Potassium bis(trifluoromethanesulfonyl)imide (EF-N112, K-TFSI available from Mitsubishi Materials Electronic Chemicals Co., Ltd.)

Crosslinking acceleration assisting agent: Zinc oxide Type-2 (available from Sakai Chemical Industry Co., Ltd.) Acid accepting agent: Hydrotalcites (DHT-4A (registered trade name) 2 available from Kyowa Chemical Industry Co., Ltd.) Filler: Electrically conductive carbon black (particulate acetylene black DENKA BLACK (registered trade name) available from Denki Kagaku Kogyo K.K.) Processing aid: Zinc stearate (SZ-2000 available from Sakai Chemical Industry Co., Ltd.)

Antiaging agent: Nickel dibutyldithiocarbamate (NOCRAC (registered trade name) NBC available from Ouchi Shinko Chemical Industrial Co., Ltd.)

While the resulting mixture was continuously kneaded, the following crosslinking component was added to and further kneaded with the mixture. Thus, a rubber composition was prepared.

TABLE 2

| Ingredients | Parts by mass |
|---|---|
| Dispersive sulfur | 1.50 |
| Accelerating agent TS | 0.50 |
| Accelerating agent DM | 1.50 |
| Thiourea crosslinking agent | 0.60 |
| Accelerating agent DT | 0.54 |

The ingredients shown in Table 2 are as follows. The amounts (parts by mass) shown in Table 2 are based on 100 parts by mass of the overall rubber component.

Dispersive sulfur: Crosslinking agent (SULFAX PS (trade name) available from Tsurumi Chemical Industry Co., Ltd. and having a sulfur content of 99.5%)

Accelerating agent TS: Tetramethylthiuram monosulfide (thiuram accelerating agent SANCELER (registered trade name) TS available from Sanshin Chemical Industry Co., Ltd.)

Accelerating agent DM: Di-2-benzothiazolyl disulfide (thiazole accelerating agent NOCCELER (registered trade name) DM available from Ouchi Shinko Chemical Industrial Co., Ltd.)

Thiourea crosslinking agent: Ethylene thiourea (2-mercaptoimidazoline ACCEL (registered trade name) 22-S available from Kawaguchi Chemical Industry Co., Ltd.)

Accelerating agent DT: 1,3-di-o-tolylguanidine (guanidine accelerating agent SANCELER DT available from Sanshin Chemical Industry Co., Ltd.)

(Production of Charging Roller)

The rubber composition thus prepared was fed into a ϕ60 extruder, and extruded into a tubular body having an outer diameter of 11.0 mm and an inner diameter of 5.0 mm. Then, the tubular body was cut, then fitted around a temporary crosslinking shaft, and crosslinked in a vulcanization can at 160° C. for 30 minutes.

Then, the crosslinked tubular body was removed from the temporary shaft, then fitted around a metal shaft having an outer diameter of 6 mm and an outer peripheral surface to which an electrically conductive thermosetting adhesive agent (polyamide adhesive agent) was applied, and heated in an oven at 150° C. for 60 minutes. Thus, the tubular body was bonded to the metal shaft. In turn, opposite end portions of the tubular body were trimmed, and the outer peripheral surface of the resulting tubular body was dry-polished to an outer diameter of 9.5 mm by means of a wide polishing machine.

Figure 2:
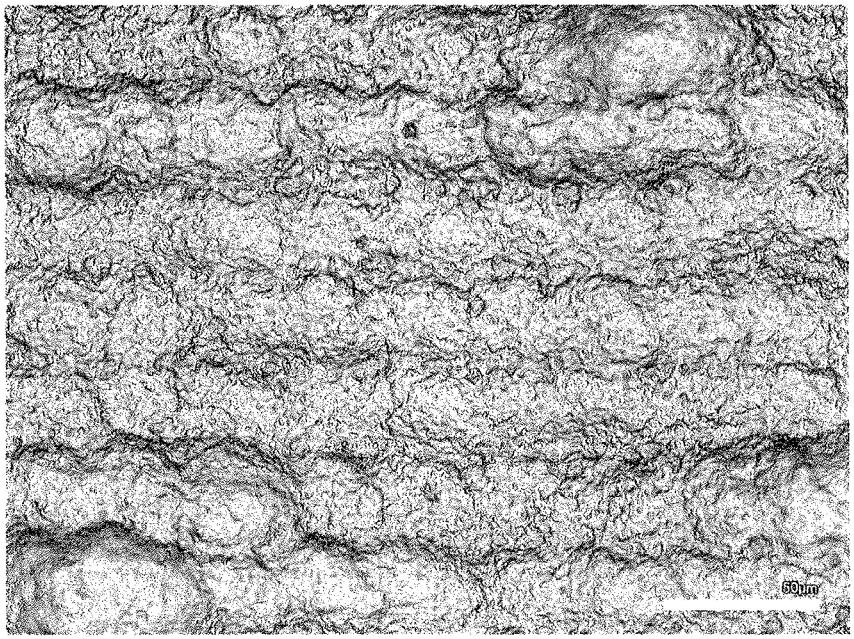
FIG. 2 is an actual microscopic photograph showing a part of an outer peripheral surface of a roller body of a charging roller according to Example 1 of the present invention on an enlarged scale.

The polished outer peripheral surface was wiped with alcohol, and then laser-processed by means of a laser processing machine (Fiber Laser Marker ML-7320DL available from Amada Miyachi Co., Ltd.) to be thereby formed with lower-frequency asperities of a surface waviness component as shown in FIG. 2. For the laser processing, the laser output was properly controlled so that the irradiation spot movement pitch was 40 μm and the overlapping degree of adjacent irradiation spots was 20%.

After the laser-processed outer peripheral surface was wiped with alcohol again, the resulting tubular body was set in a UV treatment apparatus with the outer peripheral surface thereof spaced 50 mm from a UV light source. Then, the outer peripheral surface was irradiated with ultraviolet radiation for 15 minutes while the tubular body was rotated at 300 rpm, whereby an oxide film was formed in the outer peripheral surface. Thus, a charging roller was produced.

The outer peripheral surface of the roller body of the charging roller thus produced had a surface roughness component void volume Vv of 0.20 $ml/m^2$ (○) and a surface waviness component void volume Vv of 1.90 $ml/m^2$ (○). The asperities of the surface waviness component had an average concavity depth of 6 μm, and an arithmetic mean height Sa of 1.3 μm.

Example 2

Figure 3:
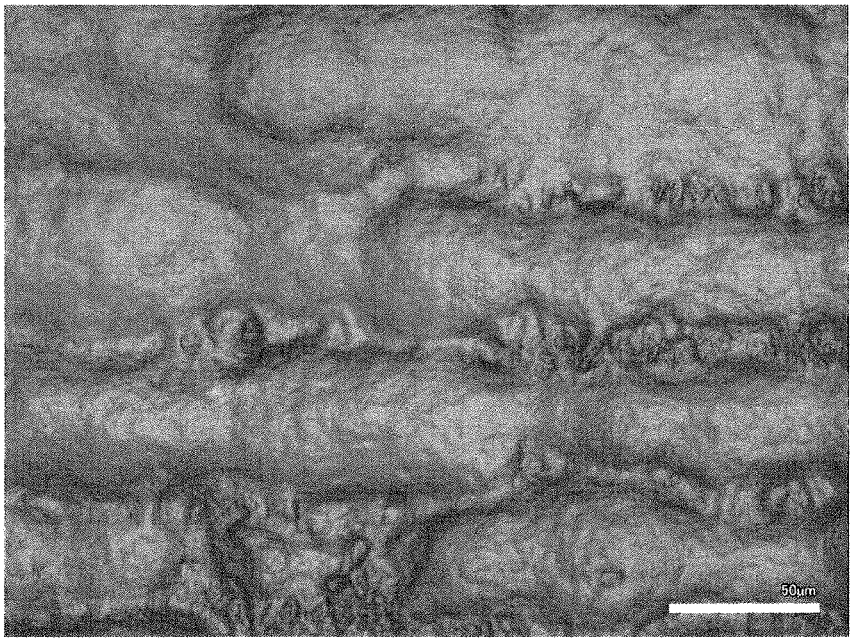
FIG. 3 is an actual microscopic photograph showing a part of an outer peripheral surface of a roller body of a charging roller according to Example 2 on an enlarged scale.

A charging roller was produced in substantially the same manner as in Example 1, except that the laser output for the laser processing was controlled so that the irradiation spot movement pitch was 60 μm and the overlapping degree of adjacent irradiation spots was 30%. The laser-processed outer peripheral surface of the charging roller is shown in FIG. 3.

The outer peripheral surface of the roller body of the charging roller thus produced had a surface roughness component void volume Vv of 0.20 ml/m$^2$ (○) and a surface waviness component void volume Vv of 4.00 ml/m$^2$ (○). The asperities of the surface waviness component had an average concavity depth of 9 μm, and an arithmetic mean height Sa of 2.7 μm.

Example 3

In the same manner as in Example 1, a tubular body was produced by using the same rubber composition as in Example 1 and fitted around a metal shaft, and opposite end portions of the tubular body were trimmed. The outer peripheral surface of the tubular body was polished by a dry traverse polishing method by means of a cylindrical polishing machine. Then, the outer peripheral surface was finished to an outer diameter of 9.5 mm (with a tolerance of 0.05) by a mirror polishing method with the use of a #1000 wrapping film (MIRROR FILM (registered trade name) available from Sankyo Rikagaku Co., Ltd.)

Figure 4:
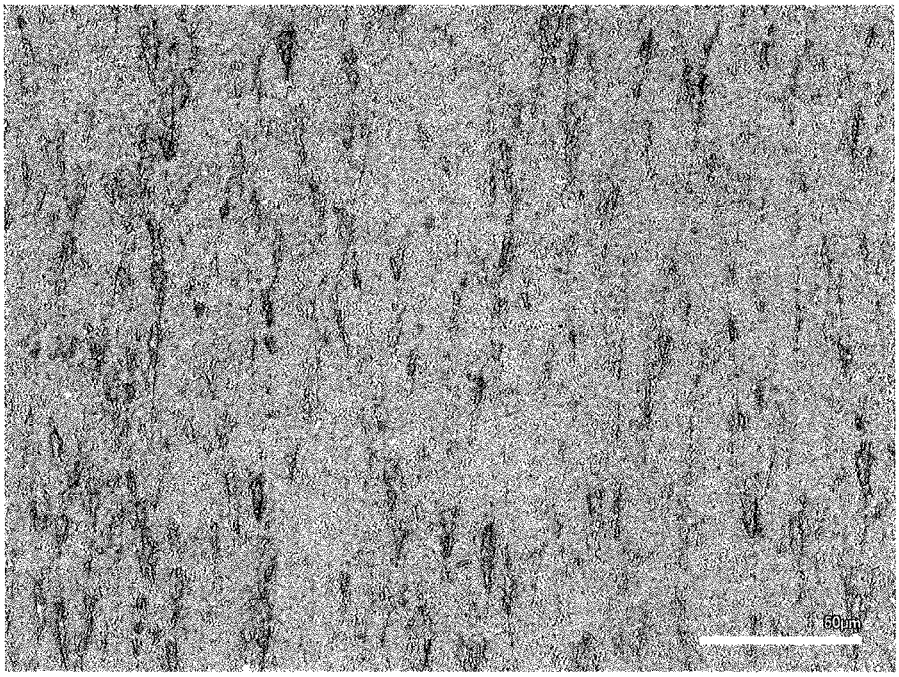
FIG. 4 is an actual microscopic photograph showing a part of an outer peripheral surface of a roller body of a charging roller according to Example 3 on an enlarged scale.

The polished outer peripheral surface was wiped with alcohol, and then processed by a wet blasting method by means of a wet blast machine (available from Macoho Co., Ltd.) For the blasting, FUJI RANDOM A (brown fused alumina particles having a new Mohs hardness of 12, an average particle diameter of 6.7±0.6 μm and Grain No. 2000) available from Fuji Manufacturing Co., Ltd. was used as fine abrasive particles. In the wet blasting, the fine particle blasting pressure was 0.3 Mpa, and the blasting period was 7.5 minutes. The outer peripheral surface processed by the blasting method is shown in FIG. 4.

After the outer peripheral surface processed by the wet blasting method was wiped with alcohol again, the resulting tubular body was set in a UV treatment apparatus with the outer peripheral surface thereof spaced 50 mm from a UV light source. Then, the outer peripheral surface was irradiated with ultraviolet radiation for 15 minutes while the tubular body was rotated at 300 rpm, whereby an oxide film was formed in the outer peripheral surface. Thus, a charging roller was produced.

The outer peripheral surface of the roller body of the charging roller thus produced had a surface roughness component void volume Vv of 0.22 ml/m$^2$ (○) and a surface waviness component void volume Vv of 0.28 ml/m$^2$ (○). The asperities of the surface waviness component had an arithmetic mean height Sa of 0.2 μm.

Example 4

Figure 5:
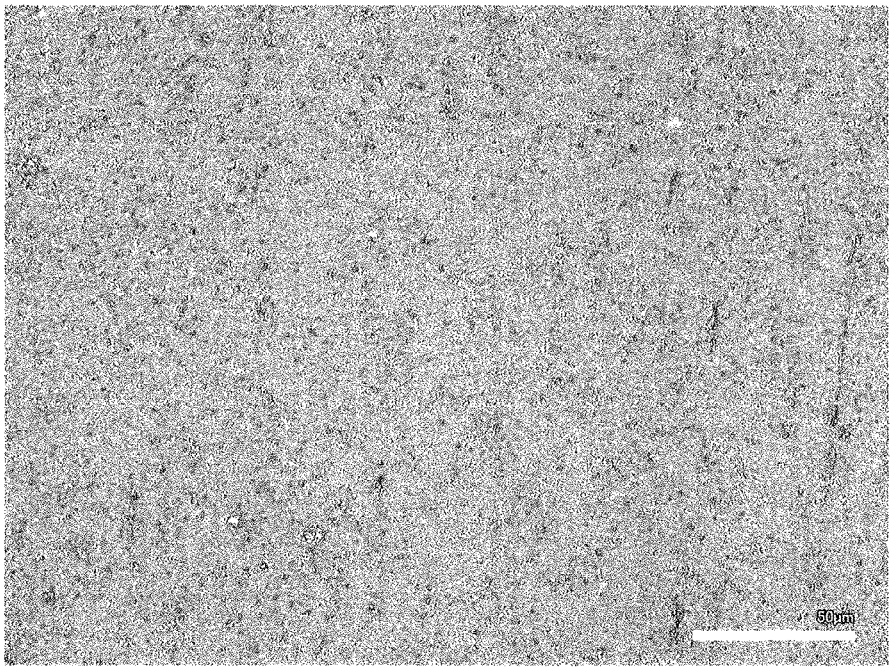
FIG. 5 is an actual microscopic photograph showing a part of an outer peripheral surface of a roller body of a charging roller according to Example 4 on an enlarged scale.

A charging roller was produced in substantially the same manner as in Example 3, except that the fine particle blasting period was 12 minutes in the wet blasting. The outer peripheral surface processed by the blasting method is shown in FIG. 5.

The outer peripheral surface of the roller body of the charging roller thus produced had a surface roughness component void volume Vv of 0.09 ml/m$^2$ (○) and a surface waviness component void volume Vv of 0.08 ml/m$^2$ (○). The asperities of the surface waviness component had an arithmetic mean height Sa of 0.15 μm.

Example 5

Figure 6:
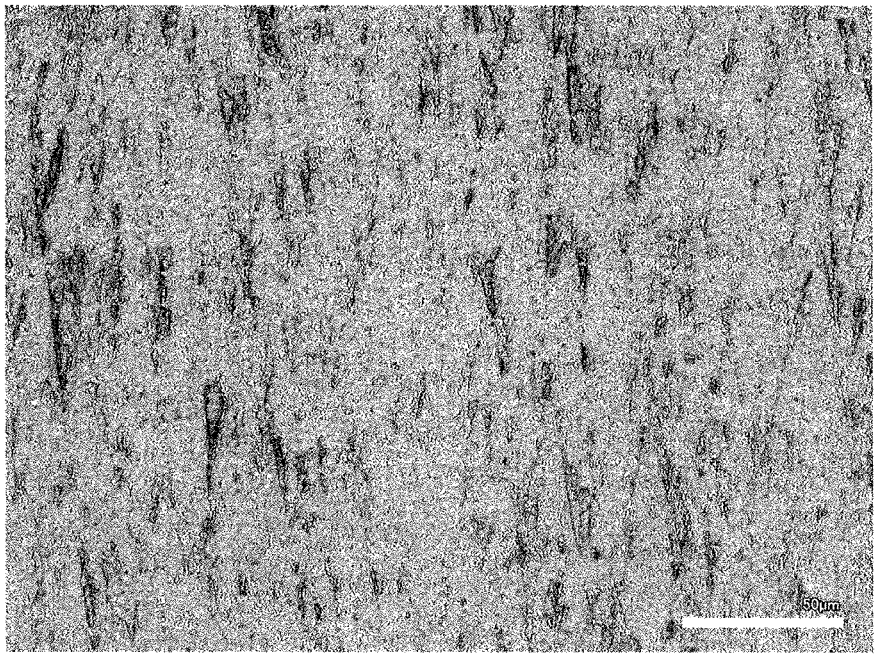
FIG. 6 is an actual microscopic photograph showing a part of an outer peripheral surface of a roller body of a charging roller according to Example 5 on an enlarged scale.

A charging roller was produced in substantially the same manner as in Example 3, except that the fine particle blasting period was 3 minutes in the wet blasting. The outer peripheral surface processed by the blasting method is shown in FIG. 6.

The outer peripheral surface of the roller body of the charging roller thus produced had a surface roughness component void volume Vv of 0.26 ml/m$^2$ (○) and a surface waviness component void volume Vv of 0.37 ml/m$^2$ (○). The asperities of the surface waviness component had an arithmetic mean height Sa of 0.35 μm.

Example 6

In the same manner as in Example 1, a tubular body was produced by using the same rubber composition as in Example 1 and fitted around a metal shaft, and opposite end portions of the tubular body were trimmed. The outer peripheral surface of the tubular body was polished by a dry traverse polishing method by means of a cylindrical polishing machine. Then, the outer peripheral surface was finished to an outer diameter of 9.5 mm by a mirror polishing method with the use of a #400 wrapping film (MIRROR FILM available from Sankyo Rikagaku Co., Ltd.)

Figure 7:
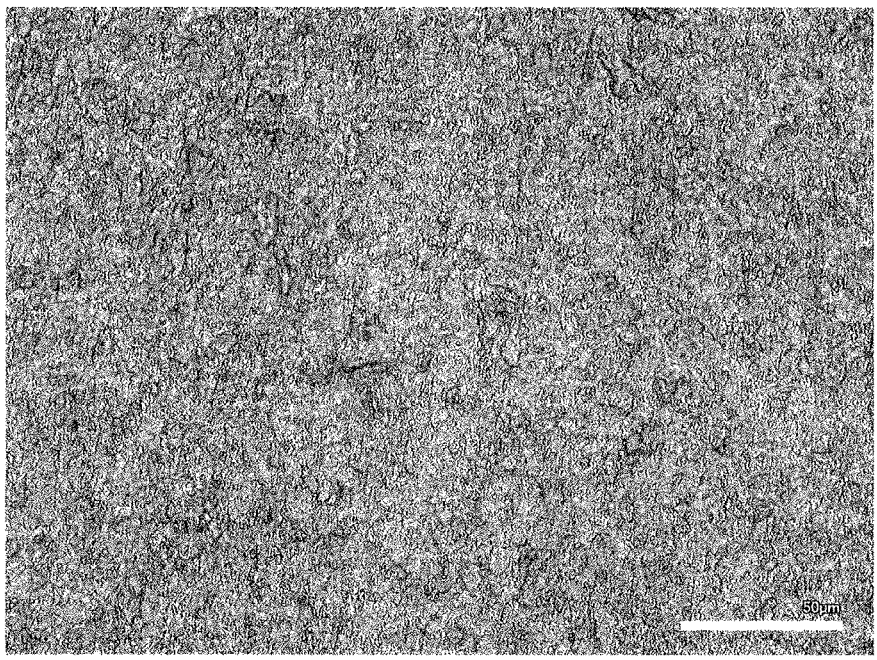
FIG. 7 is an actual microscopic photograph showing a part of an outer peripheral surface of a roller body of a charging roller according to Example 6 on an enlarged scale.

The polished outer peripheral surface was wiped with alcohol, and then processed by a dry blasting method by means of an air blast machine (available from Atsuchi Tekko Co., Ltd.) For the blasting, FUJI RANDOM A (brown fused alumina particles having a new Mohs hardness of 12, an average particle diameter of 40.0±2.5 μm, and Grain No. 320) available from Fuji Manufacturing Co., Ltd. was used as fine abrasive particles. In the dry blasting, the fine particle blasting pressure was 0.6 Mpa, and the blasting period was 3 minutes. The outer peripheral surface processed by the blasting method is shown in FIG. 7.

After the outer peripheral surface processed by the dry blasting method was wiped with alcohol again, the resulting tubular body was set in a UV treatment apparatus with the outer peripheral surface thereof spaced 50 mm from a UV light source. Then, the outer peripheral surface was irradiated with ultraviolet radiation for 15 minutes while the tubular body was rotated at 300 rpm, whereby an oxide film was formed in the outer peripheral surface. Thus, a charging roller was produced.

The outer peripheral surface of the roller body of the charging roller thus produced had a surface roughness component void volume Vv of 0.28 ml/m$^2$ (○) and a surface waviness component void volume Vv of 0.37 ml/m$^2$ (○). The asperities of the surface waviness component had an arithmetic mean height Sa of 0.4 μm.

Comparative Example 1

Figure 8:
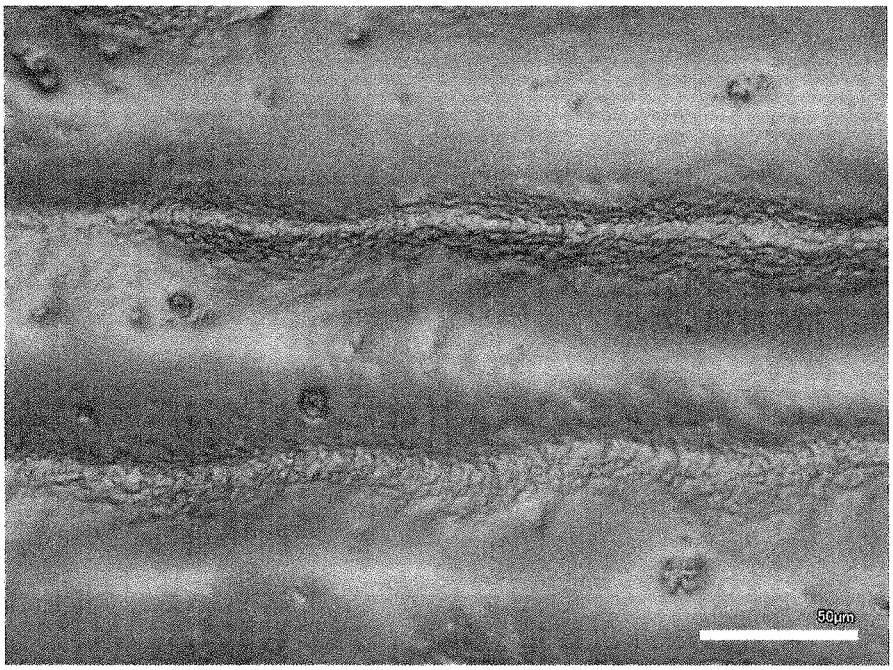
FIG. 8 is an actual microscopic photograph showing a part of an outer peripheral surface of a roller body of a charging roller according to Comparative Example 1 on an enlarged scale.

A charging roller was produced in substantially the same manner as in Example 1, except that the laser output for the laser processing was controlled so that the irradiation spot movement pitch was 80 μm and the overlapping degree of adjacent irradiation spots was 30%. The laser-processed outer peripheral surface of the charging roller is shown in FIG. 8.

The outer peripheral surface of the roller body of the charging roller thus produced had a surface roughness component void volume Vv of 0.20 ml/m$^2$ (○) and a surface waviness component void volume Vv of 7.10 ml/m$^2$ (x). The asperities of the surface waviness component had an average concavity depth of 15 μm and an arithmetic mean height Sa of 3.6 μm.

Comparative Example 2

Figure 9:
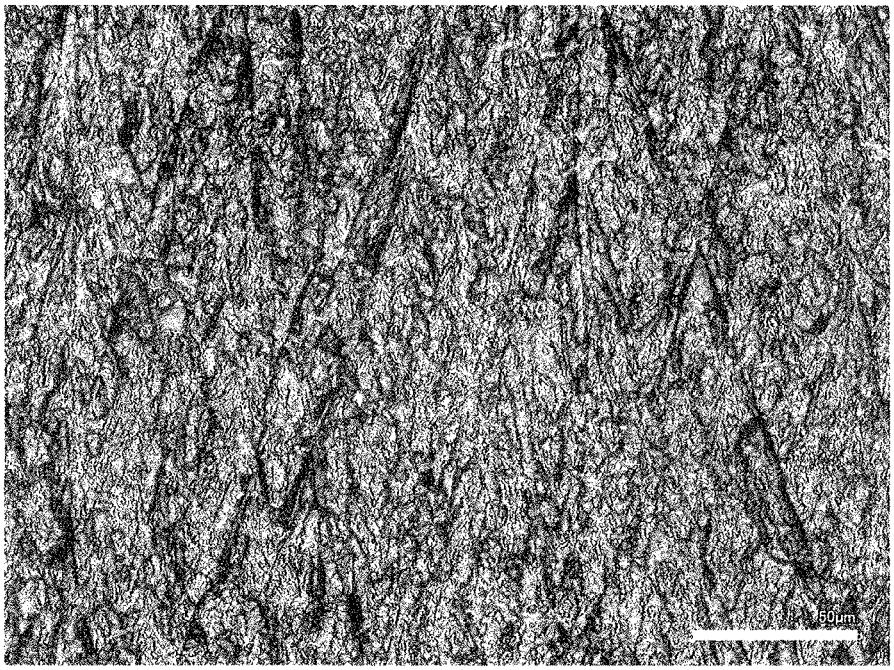
FIG. 9 is an actual microscopic photograph showing a part of an outer peripheral surface of a roller body of a charging roller according to Comparative Example 2 on an enlarged scale.

A charging roller was produced in substantially the same manner as in Example 1, except that the polished outer peripheral surface was subjected to neither the laser processing nor the blasting but immediately finished by a mirror-polishing method with the use of a #400 wrapping film (MIRROR FILM available from Sankyo Rikagaku Co., Ltd.) and, after being wiped with alcohol, formed with an oxide film by irradiation with ultraviolet radiation. The outer peripheral surface of the charging roller is shown in FIG. 9.

The outer peripheral surface of the roller body of the charging roller thus produced had a surface roughness component void volume Vv of 1.19 ml/m$^2$ (x) and a surface waviness component void volume Vv of 1.37 ml/m$^2$ (○). The arithmetic mean height Sa was 2.2 μm.

Comparative Example 3

Figure 10:
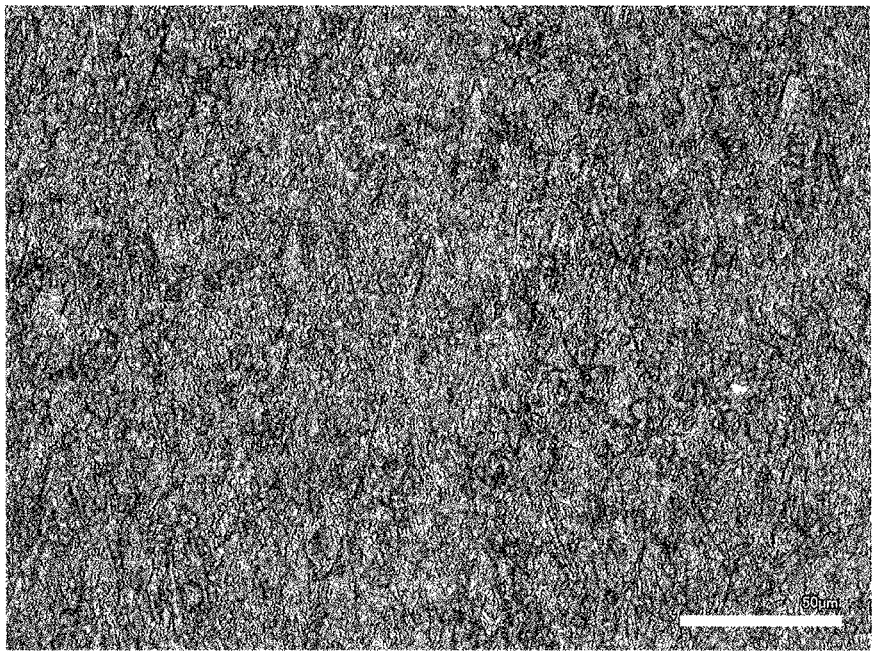
FIG. 10 is an actual microscopic photograph showing a part of an outer peripheral surface of a roller body of a charging roller according to Comparative Example 3 on an enlarged scale.

A charging roller was produced in substantially the same manner as in Example 1, except that the polished outer peripheral surface was subjected to neither the laser processing nor the blasting but immediately finished by a mirror-polishing method with the use of a #1000 wrapping film (MIRROR FILM available from Sankyo Rikagaku Co., Ltd.) and, after being wiped with alcohol, formed with an oxide film by irradiation with ultraviolet radiation. The outer peripheral surface of the charging roller is shown in FIG. 10.

The outer peripheral surface of the roller body of the charging roller thus produced had a surface roughness component void volume Vv of 0.68 ml/m$^2$ (x) and a surface waviness component void volume Vv of 0.38 ml/m$^2$ (○). The arithmetic mean height Sa was 0.9 μm.

Comparative Example 4

Figure 11:
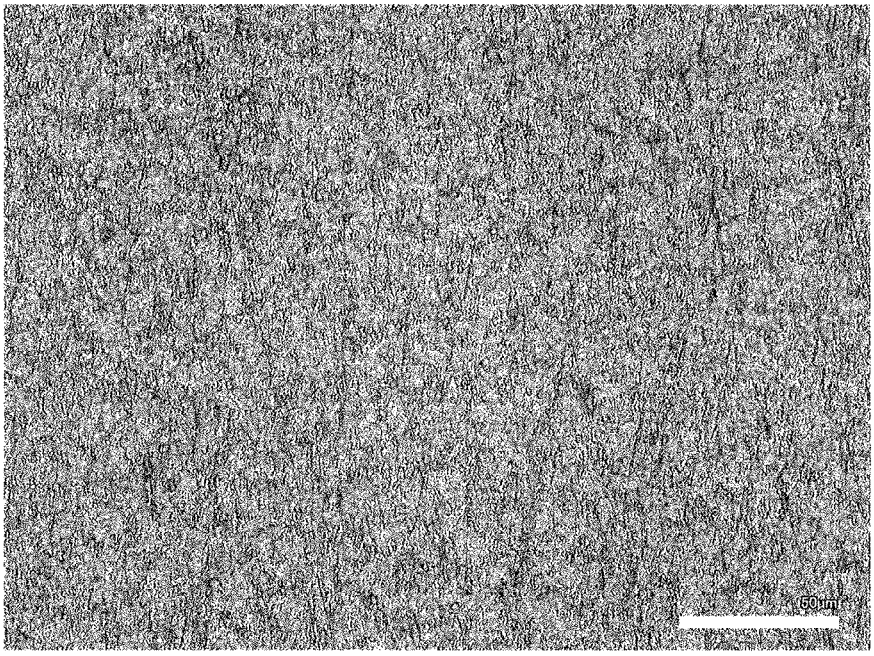
FIG. 11 is an actual microscopic photograph showing a part of an outer peripheral surface of a roller body of a charging roller according to Comparative Example 4 on an enlarged scale.

A charging roller was produced in substantially the same manner as in Example 1, except that the polished outer peripheral surface was subjected to neither the laser processing nor the blasting and, after being wiped with alcohol, formed with an oxide film by irradiation with ultraviolet radiation. The outer peripheral surface of the charging roller is shown in FIG. 11.

The outer peripheral surface of the roller body of the charging roller thus produced had a surface roughness component void volume Vv of 0.30 ml/m$^2$ (x) and a surface waviness component void volume Vv of 0.10 ml/m$^2$ (○). The arithmetic mean height Sa was 0.2 μm.

<Actual Machine Test>

A photoconductor unit (available from Lexmark International, Inc.) including a photoreceptor body and a charging roller constantly kept in contact with the surface of the photoreceptor body and attachable to a laser printer main body was prepared, and the charging rollers produced in Examples and Comparative Examples were each incorporated instead of the original charging roller in the photoconductor unit.

After the photoconductor unit thus assembled was mounted in a color laser printer (CS510de available from Lexmark International, Inc.), a 300-lpi image having an image density of 30% was continuously formed on 30,000 paper sheets at a rate of 2 sheets per 25 seconds. A charging roller suffering from imaging failure on at least one of the 30,000 paper sheets was rated as unacceptable (x), and a charging roller free from the imaging failure was rated as acceptable (○).

After the continuous image formation, the charging roller was taken out, and the outer peripheral surface of the charging roller was visually checked. A charging roller having an outer peripheral surface significantly whitened due to adhesion of fine particles was rated as unacceptable (x), and a charging roller having an outer peripheral surface slightly whitened as compared with the charging roller rated as unacceptable (x) was rated as practically acceptable (Δ). A charging roller having an outer peripheral surface free from the whitening was rated as acceptable (○).

The above results are shown in Tables 3 and 4.

TABLE 3

| | Example 1 | Example 2 | Example 3 | Example 4 | Example 5 | Example 6 |
|---|---|---|---|---|---|---|
| Mirror-polishing | No | No | Yes | Yes | Yes | Yes |
| Film (#) | — | — | 1000 | 1000 | 1000 | 400 |
| Laser processing | Yes | Yes | No | No | No | No |
| Pitch (μm) | 40 | 60 | — | — | — | — |
| Overlapping degree (%) | 20 | 30 | — | — | — | — |
| Blasting | No | No | Wet | Wet | Wet | Dry |
| Grain No. | — | — | 2000 | 2000 | 2000 | 320 |
| Pressure (MPa) | — | — | 0.3 | 0.3 | 0.3 | 0.6 |
| Period (minute) | — | — | 7.5 | 12 | 3 | 3 |
| Surface geometry | FIG. 2 | FIG. 3 | FIG. 4 | FIG. 5 | FIG. 6 | FIG. 7 |
| Surface roughness component | | | | | | |
| Void volume Vv (ml/m$^2$) | 0.20 | 0.20 | 0.22 | 0.09 | 0.26 | 0.28 |
| Evaluation | ○ | ○ | ○ | ○ | ○ | ○ |
| Surface waviness component | | | | | | |
| Void volume Vv (ml/m$^2$) | 1.90 | 4.00 | 0.28 | 0.08 | 0.37 | 0.37 |
| Evaluation | ○ | ○ | ○ | ○ | ○ | ○ |
| Depth of concavities (μm) | 6 | 9 | — | — | — | — |
| Arithmetic mean height Sa (μm) | 1.3 | 2.7 | 0.2 | 0.15 | 0.35 | 0.4 |
| Evaluation | | | | | | |
| Imaging failure | ○ | ○ | ○ | ○ | ○ | ○ |
| Whitening | ○ | ○ | ○ | Δ | ○ | ○ |

TABLE 4

| | Comparative Example 1 | Comparative Example 2 | Comparative Example 3 | Comparative Example 4 |
|---|---|---|---|---|
| Mirror-polishing | No | Yes | Yes | No |
| Film (#) | — | 400 | 1000 | — |
| Laser processing | Yes | No | No | No |
| Pitch (μm) | 80 | — | — | — |
| Overlapping degree (%) | 30 | — | — | — |
| Blasting | No | No | No | No |
| Grain No. | — | — | — | — |
| Pressure (MPa) | — | — | — | — |
| Period (minute) | — | — | — | — |
| Surface geometry | FIG. 8 | FIG. 9 | FIG. 10 | FIG. 11 |
| Surface roughness component | | | | |
| Void volume Vv ($ml/m^2$) | 0.20 | 1.19 | 0.68 | 0.30 |
| Evaluation | ○ | x | x | x |
| Surface waviness component | | | | |
| Void volume Vv ($ml/m^2$) | 7.10 | 1.37 | 0.38 | 0.10 |
| Evaluation | x | ○ | ○ | ○ |
| Depth of concavities (μm) | 15 | — | — | — |
| Arithmetic mean height Sa (μm) | 3.6 | 2.2 | 0.9 | 0.2 |
| Evaluation | | | | |
| Imaging failure | x | x | x | ○ |
| Whitening | ○ | x | x | x |

The results for Examples 1 to 6 and Comparative Examples 1 to 4 shown in Tables 3 and 4 indicate that, where the outer peripheral surface of the roller body is processed so as to have a surface roughness component void volume Vv of less than 0.3 $ml/m^2$ and a surface waviness component void volume Vv of not less than 0.05 $ml/m^2$ and not greater than 6 $ml/m^2$, the resulting charging roller has a simple construction without the provision of the coating film and yet is capable of uniformly electrically charging the surface of the photoreceptor body and more advantageously suppressing the adhesion and the accumulation of the fine particles to be thereby substantially free from the imaging failure.

The results for Examples 1 to 6 indicate that, for further improvement of the aforementioned effect, the surface roughness component void volume Vv is preferably not less than 0.1 $ml/m^2$ and not greater than 0.28 $ml/m^2$ in the aforementioned range and the surface waviness component void volume Vv is preferably not less than 0.1 $ml/m^2$ and not greater than 4 $ml/m^2$ in the aforementioned range.

This application corresponds to Japanese Patent Application No. 2017-009486 filed in the Japan Patent Office on Jan. 23, 2017 and Japanese Patent Application No. 2017-076825 filed in the Japan Patent Office on Apr. 7, 2017, the disclosures of which are incorporated herein by reference in their entireties.

What is claimed is:

1. A charging roller comprising a roller body having an outer peripheral surface which includes a surface roughness component including a multiplicity of asperities and having a void volume Vv of less than 0.3 $ml/m^2$, and a surface waviness component including a multiplicity of asperities having a lower frequency than the surface roughness component and having a void volume Vv of not less than 0.05 $ml/m^2$ and not greater than 6 $ml/m^2$, the void volumes Vv being each defined as a sum Vvc+Vvv of a core void volume Vvc and a dale void volume Vvv specified by International Organization for Standardization ISO 25178-2:2012.

2. The charging roller according to claim 1, wherein the outer peripheral surface of the roller body comprises a crosslinked rubber, and is formed with an oxide film.

3. A charging roller production method for producing a charging roller, comprising the steps of:

forming a tubular roller body by crosslinking a rubber composition;

polishing an outer peripheral surface of the formed tubular roller body, so that the roller body has a predetermined outer diameter; and finishing the polished outer peripheral surface of the roller body by at least one method selected from the group consisting of a laser processing method, a wet blasting method and a dry blasting method, so that the outer peripheral surface includes a surface roughness component having a void volume Vv of less than 0.3 $ml/m^2$, and a surface waviness component having a void volume Vv of not less than 0.05 $ml/m^2$ and not greater than 6 $ml/m^2$.

4. The charging roller production method according to claim 3, further comprising the step of forming an oxide film in the outer peripheral surface of the roller body through oxidation of rubber present in the outer peripheral surface by irradiating the outer peripheral surface with ultraviolet radiation after the finishing step.

* * * * *